US007956304B2

(12) United States Patent
Bacigalupe et al.

(10) Patent No.: US 7,956,304 B2
(45) Date of Patent: Jun. 7, 2011

(54) COMBINATION SWITCH

(75) Inventors: Carlos Bacigalupe, Rocas Santo Domingo (CL); Michael J. Dobie, Double Oak, TX (US)

(73) Assignee: Turbochef Technologies, Inc., Atlanta, GA (US)

( * ) Notice: Subject to any disclaimer, the term of this patent is extended or adjusted under 35 U.S.C. 154(b) by 199 days.

(21) Appl. No.: 12/090,682

(22) PCT Filed: Nov. 8, 2006

(86) PCT No.: PCT/US2006/043569

§ 371 (c)(1),
(2), (4) Date: May 12, 2008

(87) PCT Pub. No.: WO2007/056489

PCT Pub. Date: May 18, 2007

(65) Prior Publication Data

US 2008/0257700 A1 Oct. 23, 2008

Related U.S. Application Data

(60) Provisional application No. 60/734,918, filed on Nov. 9, 2005.

(51) Int. Cl.
*H01H 9/20* (2006.01)

(52) U.S. Cl. ..... 200/334; 292/198; 200/61.81

(58) Field of Classification Search ..... 200/334; 292/198

See application file for complete search history.

(56) References Cited

U.S. PATENT DOCUMENTS

| | | | | |
|---|---|---|---|---|
| 4,745,250 | A | 5/1988 | Mayo | |
| 5,300,745 | A * | 4/1994 | Chartrain et al. | 219/722 |
| 5,933,065 | A * | 8/1999 | Duchemin | 335/190 |
| 6,079,756 | A * | 6/2000 | Phillips | 292/198 |
| 6,135,336 | A * | 10/2000 | Linderoth | 226/183 |
| 6,315,336 | B1 * | 11/2001 | Swartzell | 292/201 |

FOREIGN PATENT DOCUMENTS

| | | |
|---|---|---|
| EP | 0663788 A1 | 7/1995 |
| EP | 1102519 A1 | 5/2001 |

OTHER PUBLICATIONS

International Search Report and Written Opinion in related Application No. PCT/US2006/043569.

* cited by examiner

*Primary Examiner* — Renee Luebke
*Assistant Examiner* — Lisa Klaus
(74) *Attorney, Agent, or Firm* — Dean W. Russell; Kristin M. Crall; Kilpatrick Townsend & Stockton LLP

(57) ABSTRACT

A combination switch is provided for a high-speed oven, the oven having a door. The combination switch has a rotatable cam (40) that is rotated when the door of the oven is moved between a closed position and an open position. The cam (40) has at least one lobe (50, 52) for engaging at least one safety-switch (44, 46) for actuation by the at least one lobe of the cam as the cam rotates. The at least one safety switch controls operation of at least a portion of the oven. A locking latch (48) is selectively moveable between an engaged position, in which the latch engages the cam (40) to limit rotation of the cam and thereby prevent opening of the door, and a disengaged position, in which the latch (48) does not engage the cam (40) and thereby allows opening of the door.

11 Claims, 4 Drawing Sheets

COMBINATION SWITCH

CROSS REFERENCE TO RELATED APPLICATION

This application is the United States national phase of International Application No. PCT/U.S.2006/043569 filed on Nov. 8, 2006 and published in English on May 18, 2007 as International Publication No. WO 2007/056489 A1, which application claims priority to U.S. Provisional Application No. 60/734,918 filed on Nov. 9, 2005, the contents of both of which are incorporated herein by reference.

BACKGROUND

1. Field of the Invention

The present invention generally relates to oven switches and particularly relates to a simplified switch mechanism to allow for microwave oven safety switches and a self-cleaning switch to be integrated into a single switching device.

2. Description of Related Art

In self cleaning ovens, it is necessary to raise the temperature of the cooking cavity to a pyrolytic level, typically in the range of approximately 900° F., to convert to ash any by-products of the cooking process that remain in the oven. For safety reasons, the oven door must be locked during the self cleaning process, and this has typically been accomplished by using a self-standing, motorized latch mechanism featuring a link or hook mounted behind the oven door frame. When activated, the latch mechanism engages the oven door to lock the door in a closed position. The latching system is typically a single mechanism mounted at the center of the oven door and activated automatically when the self cleaning cycle is initiated.

In microwave ovens, safety regulations require a safety circuit consisting of three switches connected in a manner to protect the operator from exposure to microwave energy when the oven door is opened. The switches, described as primary, secondary and monitor switches, insure the oven door is completely closed before the microwave circuit is enabled. The primary and secondary switches will prevent the flow of electric current to the microwave source when the oven door is at least partially open. The switches are operated by components mounted on the oven door, and each of the primary and secondary switches must have a different actuator to ensure redundancy or operation. The monitor switch ensures that that the oven cannot produce microwave energy in the event of failure or tampering of the primary or secondary switches. These switches must be mounted such that only the proper actuator is capable of operating them and tampering or other means will not allow the oven to produce microwave energy.

A combination oven with a self-clean feature must be equipped with both a self-cleaning safety switch and microwave safety switches. As used herein the terms "combination oven" and "multi-energy-source oven" have the same meaning and refer to ovens wherein microwave energy and some other form of thermal energy is utilized.

Although great strides have been made in the area of switches for ovens, many shortcomings remain.

SUMMARY OF THE INVENTION

There is a need for an improved switch system for a combination oven incorporating microwave safety switches and a self-cleaning cycle switch.

Therefore it is an object of the present invention to provide an improved switch system for a combination oven incorporating microwave safety switches and a self-cleaning cycle switch.

A combination switch is provided for a high-speed oven, the oven having a door. The combination switch has a rotatable cam that is rotated when the door of the oven is moved between a closed position and an open position. The cam has at least one lobe for engaging at least one safety switch for actuation by the at least one lobe of the cam as the cam rotates. The at least one safety switch controls operation of at least a portion of the oven. A locking latch is selectively moveable between an engaged position, in which the latch engages the cam to limit rotation of the cam and thereby prevent opening of the door, and a disengaged position, in which the latch does not engage the cam and thereby allows opening of the door.

The present invention provides several advantages, including: (1) providing a combination microwave safety switch and self-cleaning latch; (2) providing a simplified combination switch; and (3) providing a tamper-resistant switch.

DESCRIPTION OF THE DRAWINGS

The novel features believed to be characteristic of the invention are set forth in the appended claims. However, the invention itself, as well as a preferred mode of use, and further objectives and advantages thereof, will best be understood by reference to the following detailed description when read in conjunction with the accompanying drawings, wherein:

DETAILED DESCRIPTION OF THE PREFERRED EMBODIMENT

The present invention is directed to a simplified, compact, cam-driven switch system incorporating microwave safety switches and a self cleaning locking mechanism. The system of the invention is particularly useful when used with high-speed cooking ovens that combine electrical heating (or other types of thermal energy), microwave heating, and air impingement, the combination of which ensures high heat-transfer coefficients for cooking food much more rapidly than conventional ovens utilizing a single heat source. Combination ovens may be capable of pyrolytic self-cleaning. Although the switch system of the invention is described herein as being used with an oven using electric heating and air impingement, the switch system may be used on combination ovens having other forms of air movement and other forms of thermal energy, and the invention is not limited to use with the type of oven shown in the described embodiment.

Figure 1:
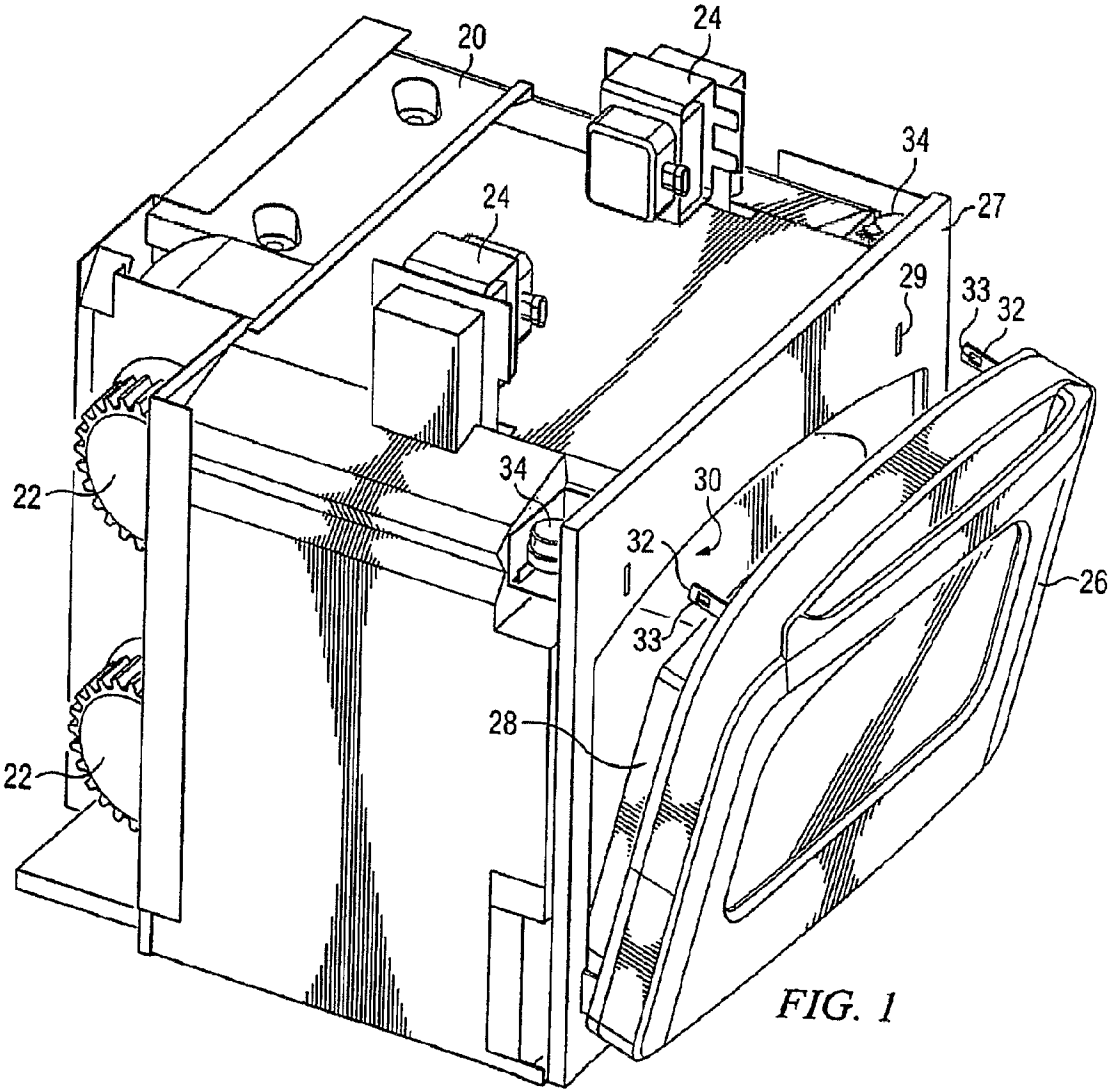
FIG. 1 is an oblique view of multi-energy-source oven having a combination switch according to the present invention.
Figure 2:
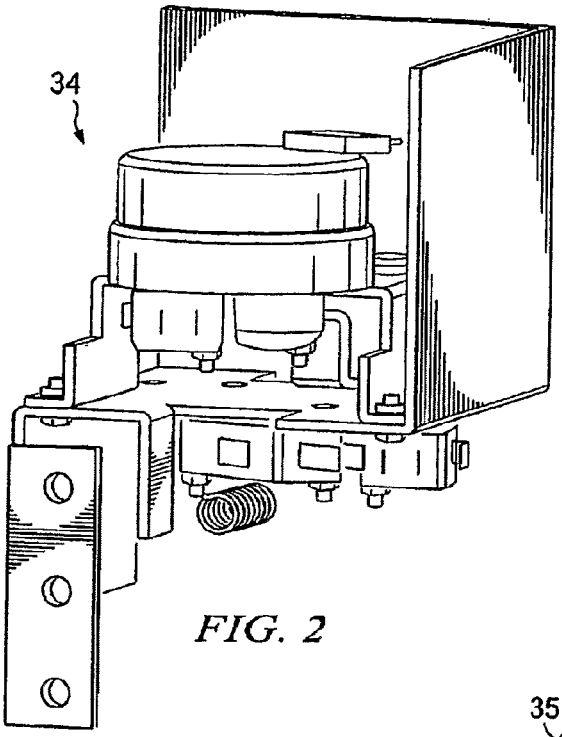
FIG. 2 is an oblique view of the combination switch of FIG. 1.

FIGS. 1 through 7 illustrate a preferred embodiment of a combination switch according to the present invention, with FIG. 1 showing the switch of the invention being installed on an exemplary version of a multi-energy-source oven. Oven 20 comprises blower motors 22, magnetrons 24, oven door 26, face 27, oven door microwave choke 28, front frame apertures 29, cooking cavity 30, left- and right-side door-mounted actuators 32, and left- and right-side combination switches 34. Each actuator 32 has a lock aperture 33 for engaging a portion of the corresponding combination switch 34. Left-side switch 34 is visible in FIG. 1, and FIG. 2 shows right-side switch 34 removed from oven 20.

Figure 3:
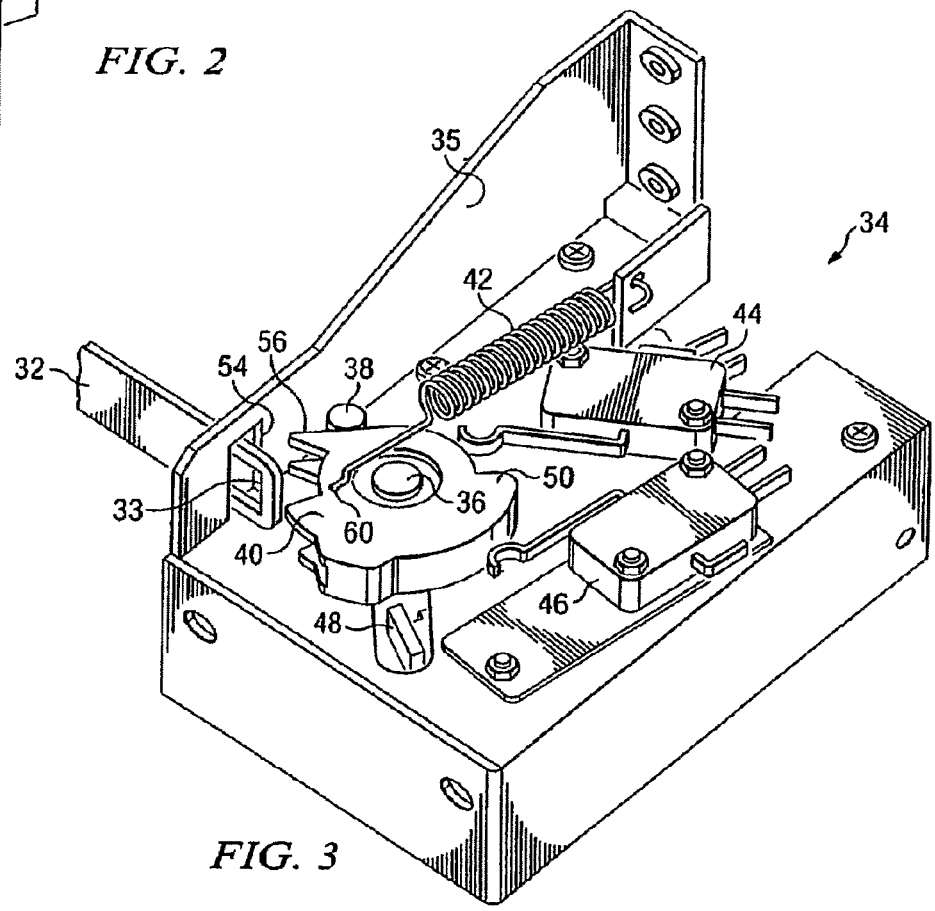
FIG. 3 is an oblique bottom view of the combination switch of FIG. 1, the components of the switch being shown in an "oven door open" orientation.
Figure 5:
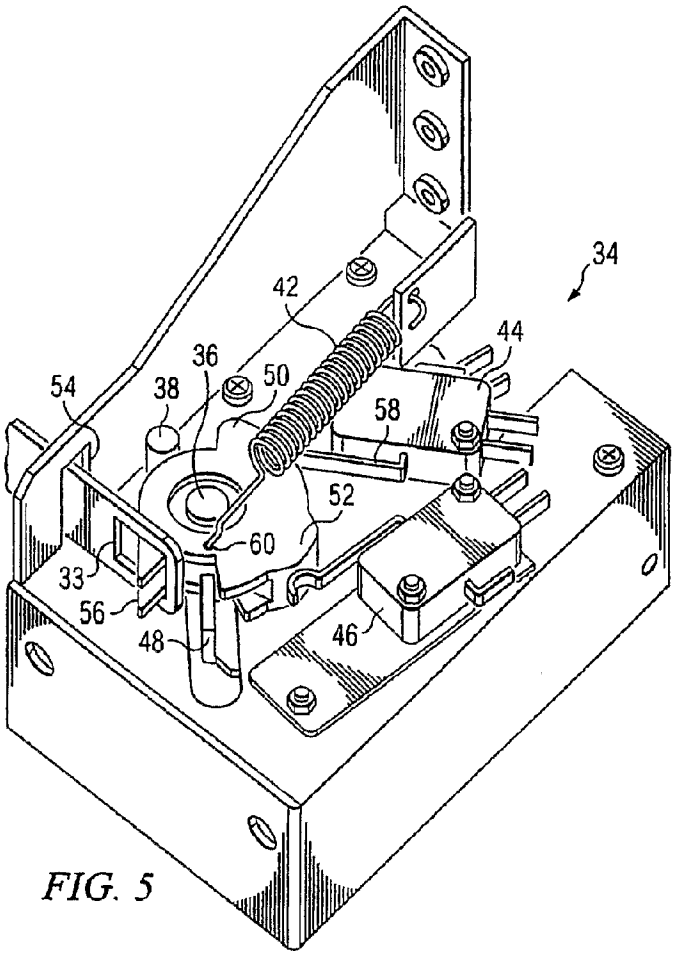
FIG. 5 is an oblique bottom view of the combination switch of FIG. 1, the components of the switch being shown in an "oven door closed, self clean latch engaged" orientation.
Figure 4:
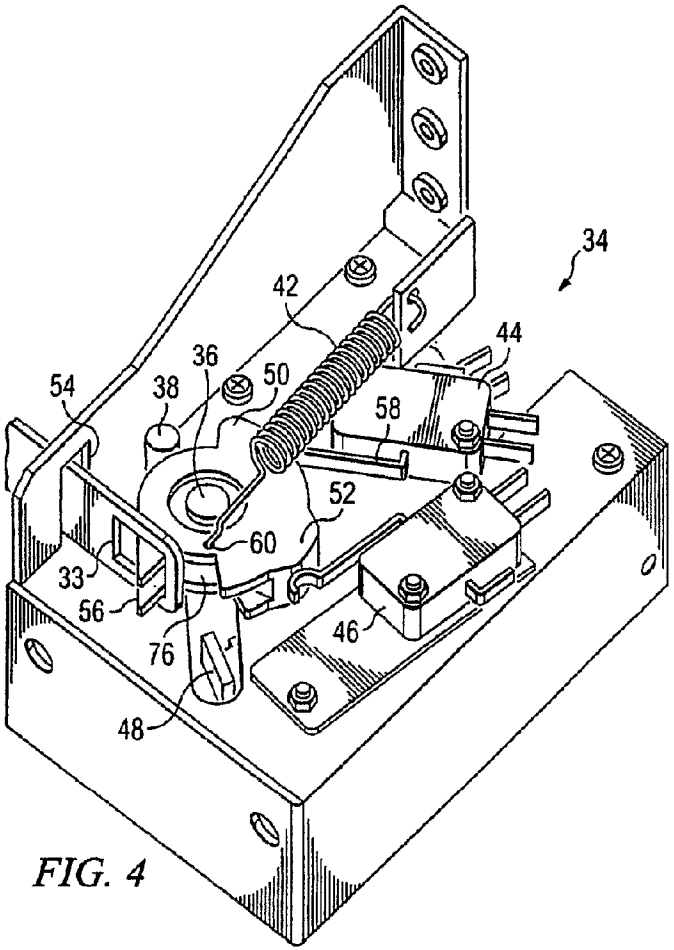
FIG. 4 is an oblique bottom view of the combination switch of FIG. 1, the components of the switch being shown in an "oven door closed" orientation.

Referring to FIGS. 3 through 5, right-side combination switch 34 is shown from the bottom, and switch 34 comprises frame 35, cam shaft 36, cam stop 38, cam 40, spring 42, microwave safety monitor switch 44, microwave secondary switch 46, and self-clean safety latch 48. Right- and left-side switches 34 are similarly constructed and configured, but each switch 34 is generally a mirror image of the other switch 34. Switch 46 on one combination switch 34 is the primary switch, and switch 46 on the other combination switch 34 is the secondary switch. One combination switch 34 will be described below, though it should be understood that the description applies equally to the other switch 34. As described herein monitor switch 44 is utilized only on one side, the right side. On the left side, the monitor switch may be replaced by another switch, for example a switch to control a light within the oven cavity.

To ensure magnetrons 24 of oven 20 is prevented from operating while door 26 is not fully closed, cam 40 is shaped to be engaged by the corresponding actuator 32 on door 26 as door 26 is opened and closed. Cam 40 is rotatable about cam shaft 36, and cam 40 comprises back lobe 50 and a secondary high lobe 52, which are formed on the peripheral edge of cam 40. Actuator 32 causes cam 40 to rotate about cam shaft 36, and cam 40 actuates switches 44, 46 at selected positions of door 26. FIG. 3 illustrates the position of components in switch 34 just before oven door 26 begins to engage the components of switch 34 when closing. Actuators 32 enter oven front frame aperture 29 and pass through an aperture 54 in frame 35.

As door 26 further closes, actuator 32 begins to engage cam engaging tooth 56 of cam 40, causing rotation of cam 40 in a counter-clockwise direction (as viewed in the figure) about cam shaft 36. This rotation causes back lobe 50 to engage arm 58 of monitor switch 44 for closing switch 44. Further rotation of cam 40 to the position in FIG. 4 causes cam engaging tooth 56 to enter lock aperture 33 of actuator 32. Spring 42 is attached at one end to cam 40 at point 60, and point 60 is located a radial distance from the center of rotation of cam 40. The opposite end of spring 42 is attached to frame 35. This ensures that spring pressure is applied to urge rotation of cam 40, which applies force to actuators 32 for causing door 26 to pull tight against face 27, thereby improving the performance of door choke 28. Additionally the pulling action of spring 42 provides the operator assistance with door closure, and the length or spring rate of spring 42 may be adjusted to achieve the desired door tension.

As illustrated in FIG. 5, once cam 40 has been fully rotated, switch 44 is activated by back lobe 50 and switch 46 has been activated later in the rotation of cam 40 by high lobe 52. Although switches 44, 46 have been illustrated as activated by lobes 50, 52, other combinations of lobes and normally open or normally closed switches may be utilized and applicant intends to encompass within this description any other combination of switches that will accomplish the same purpose and not be limited by the description herein.

Figure 6:
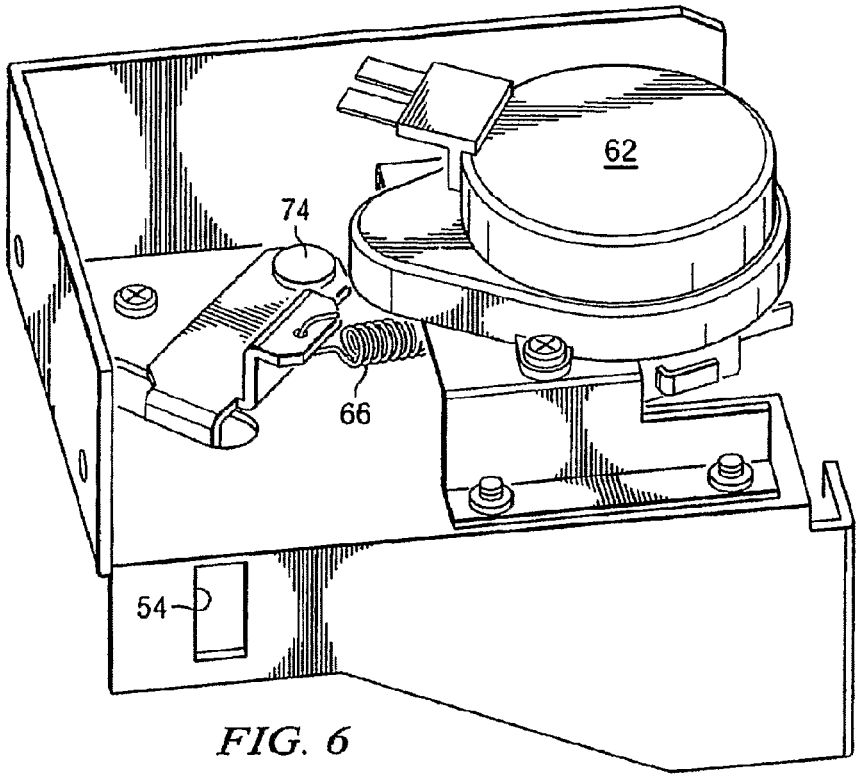
FIG. 6 is an oblique top view of the combination switch of FIG. 1, the components of the switch being shown in an "oven door closed, self-clean latch engaged" orientation.
Figure 7:
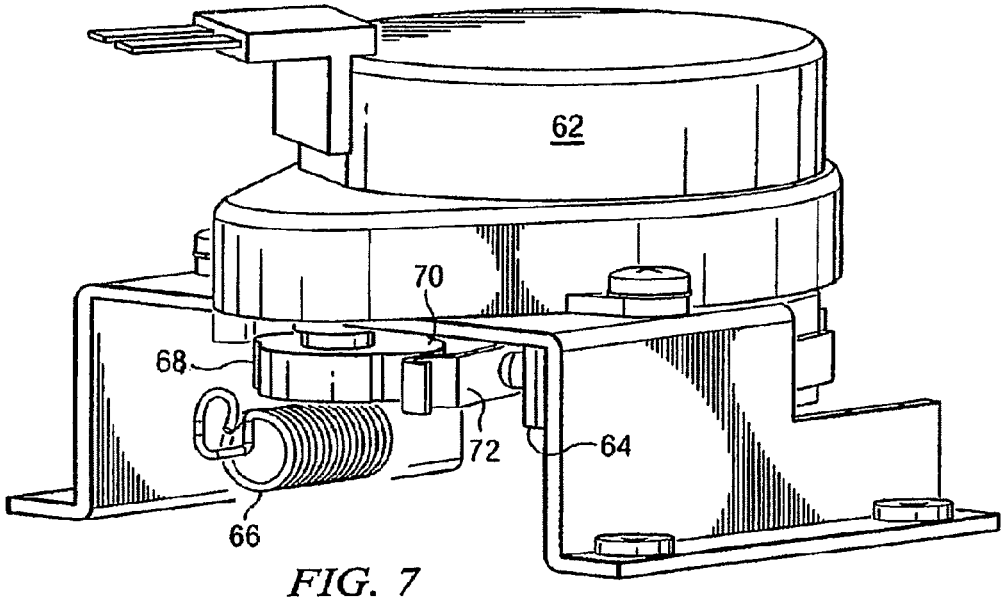
FIG. 7 is an oblique view of a portion of the combination switch of FIG. 1.

Referring to FIGS. 5 through 7, switch 34 also provides for a self-cleaning locking mechanism. FIG. 6 further illustrates right-side combination switch 34 from the top, and switch 34 further comprises locking mechanism drive system 62, locking mechanism switch 64, and spring 66. FIG. 7 shows detail of drive system 62, which also comprises a cam 68 driven in rotation by drive system 62. Spring 66 is attached at one end to cam 68 at a radial distance from the center of rotation of cam 68, and the opposite end of spring 66 is attached to self-clean safety latch 48. As drive system 62 rotates cam 68, spring 66 moves in and out pivot latch 48 about pivot point 74. In addition, cam 68 has a lobe 70 for engaging arm 72 of switch 64 as cam 68 rotates.

In those instances when self-cleaning is desired, with oven door 26 closed, a signal is sent to locking mechanism switch 64, thereby activating a motor in drive system 62. This moves the free end of latch 48 into engagement with a notch 76 in cam 40 adjacent cam engaging tooth 56. As such, door mounted actuators 32 are locked by cam 40 and will not allow oven door 26 to be opened. FIG. 4 illustrates the orientation of cam 40 and switches 44, 46 when oven door 26 is closed and self-cleaning latch 48 is disengaged. FIG. 5 illustrates the orientation of cam 40 and switches 44, 46 when oven door 26 is closed and self-cleaning latch 48 is engaged to prevent rotation of cam 40. When the self-cleaning cycle is completed, drive system 62 rotates cam 68 to a position in which spring 66 pushes latch 48 out of engagement with notch 70, allowing cam 40 to rotate, which allows door 26 to be opened.

As previously described, safety switches 44, 46 will be open and prevent electricity flowing to the microwave circuit when oven door 26 is open. Primary switch 46, secondary switch 46 (on the other combination switch 34) and monitor switches 44 are utilized in a manner wherein the primary and secondary switches 46 are mounted on different portions of door 26 and thereby operated by different actuators. As illustrated in FIG. 1, mounting of combination switch 34 at oven door top left and top right prevents deformation (e.g. flexing) of door 26. Illustrated in FIG. 1 is mounting at the top right and top left of door 26, although other mounting positions may be utilized and applicant intends to encompass within this description any mounting configuration that will accomplish the same result as the herein described orientation. As such, a left side combination switch 34 is utilized. As described above, left-side switch 34 is configured in the same manner as right-side switch 34 and houses the secondary microwave safety switch 46 and may also house additional switches, for example an oven light switch (not shown). Additionally, because cam 40 operates to engage safety switches 44, 46, the switches may be stacked one on top of the other, thereby providing redundancy of switching mechanisms (e.g. two monitor switches, two primary and two secondary switches), reducing service calls, in those instances where one of the switches fails. In that situation, the second stacked switch would still function and allow the microwave circuit to operate. It should be noted that locating combination switches 34 behind face 27 minimizes tampering with switch 34. It should also be noted that a solid pin may be substituted for spring 66 to connect cam 68 to latch 48. Spring 66 allows for disengagement of self clean safety latch 48 in those instances wherein drive system mechanism 62 fails with latch 48 engaging notch 76 in cam 40.

The present invention provides several advantages, including: (1) providing a combination microwave safety switch and self-cleaning latch; (2) providing a simplified combination switch; and (3) providing a tamper-resistant switch.

While the exemplary embodiments of the present invention have been shown and described, it will be understood that various changes and modifications to the foregoing embodiments may become apparent to those skilled in the art without departing from the spirit and scope of the present invention. Accordingly, the invention is not limited to the embodiments disclosed, but rather by the appended claims and their equivalents.

The invention claimed is:

1. A combination switch for a high-speed oven, the oven having a door, the combination switch comprising:

a rotatable cam adapted to be rotated when the door of the oven is moved between a closed position and an open position, the cam having at least one lobe;

at least one safety switch engaged by the cam for actuation by the at least one lobe of the cam as the cam rotates, the at least one safety switch being adapted to control operation of at least a portion of the oven;

a locking latch selectively moveable between an engaged position, in which the latch engages the cam to limit rotation of the cam and thereby prevent opening of the door, and a disengaged position, in which the latch does not engage the cam and thereby allows opening of the door; and a cam engaging tooth formed on the cam and adapted to engage actuators carried by the door.

2. The combination switch according to claim 1, wherein the at least one safety switch is adapted to control a flow of current to a microwave energy source.

3. The combination switch according to claim 1, further comprising a second combination switch.

4. The combination switch according to claim 1, wherein the at least one safety switch is a primary safety switch, further comprising a second combination switch having at least one safety switch, wherein the at least one safety switch of the second combination switch is a secondary safety switch.

5. A combination switch for a high-speed oven, the oven having a door, the combination switch comprising:

a rotatable cam adapted to be rotated when the door of the oven is moved between a closed position and an open position, the cam having at least one lobe;

at least one safety switch engaged by the cam for actuation by the at least one lobe of the cam as the cam rotates, the at least one safety switch being adapted to control operation of at least a portion of the oven;

a locking latch selectively moveable between an engaged position, in which the latch engages the cam to limit rotation of the cam and thereby prevent opening of the door, and a disengaged position, in which the latch does not engage the cam and thereby allows opening of the door; and wherein the cam is spring-biased in at least one direction of rotation.

6. The combination switch according to claim 5, wherein the at least one safety switch is adapted to control a flow of current to a microwave energy source.

7. The combination switch according to claim 5, further comprising a second combination switch.

8. The combination switch according to claim 5, wherein the at least one safety switch is a primary safety switch, further comprising a second combination switch having at least one safety switch, wherein the at least one safety switch of the second combination switch is a secondary safety switch.

9. A combination switch for a high-speed oven, the oven having a door, the combination switch comprising:

a rotatable cam adapted to be rotated when the door of the oven is moved between a closed position and an open position, the cam having at least one lobe;

at least one safety switch engaged by the cam for actuation by the at least one lobe of the cam as the cam rotates, the at least one safety switch being adapted to control operation of at least a portion of the oven;

a locking latch selectively moveable between an engaged position, in which the latch engages the cam to limit rotation of the cam and thereby prevent opening of the door, and a disengaged position, in which the latch does not engage the cam and thereby allows opening of the door;

a drive system for moving the locking latch between the engaged position and the disengaged position; and a cam engaging tooth formed on the cam and adapted to engage actuators carried by the door.

10. A combination switch for a high-speed oven, the oven having a door, the combination switch comprising:

a rotatable cam adapted to be rotated when the door of the oven is moved between a closed position and an open position, the cam having at least one lobe;

at least one safety switch engaged by the cam for actuation by the at least one lobe of the cam as the cam rotates, the at least one safety switch being adapted to control operation of at least a portion of the oven;

a locking latch selectively moveable between an engaged position, in which the latch engages the cam to limit rotation of the cam and thereby prevent opening of the door, and a disengaged position, in which the latch does not engage the cam and thereby allows opening of the door;

a drive system for moving the locking latch between the engaged position and the disengaged position; and wherein the cam is spring-biased in at least one direction of rotation.

11. A high-speed oven, comprising:

a cooking cavity;

a door for selectively closing the cooking cavity, the door being moveable between an open position and a closed position; and at least one combination switch, comprising:

a rotatable cam adapted to be rotated when the door is moved between the closed position and the open position, the cam defining a face and a periphery and having at least one peripheral lobe;

at least one safety switch engaged by the cam for actuation by the at least one lobe of the cam as the cam rotates, the at least one safety switch being adapted to control operation of at least a portion of the oven;

a locking latch selectively moveable between an engaged position, in which the latch engages the cam to limit rotation of the cam and thereby prevent opening of the door, and a disengaged position, in which the latch does not engage the cam and thereby allows opening of the door; and a drive system for moving the locking latch between the engaged position and the disengaged position, wherein the at least one combination switch comprises two combination switches, the combination switches being located on opposite sides of the door.

* * * * *